US008037824B1

(12) United States Patent
Plummer et al.

(10) Patent No.: US 8,037,824 B1
(45) Date of Patent: Oct. 18, 2011

(54) EXPLODING FOIL INITIATOR ACTUATED CARTRIDGE

(75) Inventors: Robert W. Plummer, McCordsville, IN (US); Brady A. Plummer, Fishers, IN (US); Robert A. Bailey, Avon, IN (US)

(73) Assignee: Raytheon Company, Waltham, MA (US)

( * ) Notice: Subject to any disclaimer, the term of this patent is extended or adjusted under 35 U.S.C. 154(b) by 426 days.

(21) Appl. No.: 12/130,626

(22) Filed: May 30, 2008

Related U.S. Application Data

(60) Provisional application No. 60/932,514, filed on May 30, 2007.

(51) Int. Cl.
*F42B 3/02* (2006.01)

(52) U.S. Cl. ..... 102/202.7

(58) Field of Classification Search ..... 102/202.7, 102/202.8, 202.9, 202.6, 205, 206, 469, 470, 102/202.5, 202.14
See application file for complete search history.

(56) References Cited

U.S. PATENT DOCUMENTS

| | | | | | |
|---|---|---|---|---|---|
| 2,237,932 | A | * | 4/1941 | Handforth et al. | 86/1.1 |
| 2,400,103 | A | * | 5/1946 | Cobb | 102/202.14 |
| 2,942,546 | A | * | 6/1960 | Liebhafsky et al. | 102/202.8 |
| 3,362,158 | A | * | 1/1968 | Thurston et al. | 60/39.47 |
| 3,438,326 | A | * | 4/1969 | Held et al. | 102/210 |
| 3,482,518 | A | * | 12/1969 | Sweetman | 102/205 |
| 3,695,178 | A | * | 10/1972 | Betts | 102/202.9 |
| 3,754,506 | A | * | 8/1973 | Parker | 102/202.8 |
| 4,368,670 | A | * | 1/1983 | Weidner | 102/202.5 |
| 4,777,878 | A | * | 10/1988 | Johnson et al. | 102/202.5 |
| 5,029,529 | A | * | 7/1991 | Mandigo et al. | 102/202.9 |
| 5,261,315 | A | * | 11/1993 | Marinos | 102/202.7 |
| 5,263,416 | A | * | 11/1993 | Amundson et al. | 102/202.9 |
| 5,825,282 | A | | 10/1998 | Aronne | |
| 6,205,927 | B1 | * | 3/2001 | Findley | 102/472 |
| 6,247,409 | B1 | * | 6/2001 | Wier | 102/202.5 |
| 6,332,402 | B1 | * | 12/2001 | Weise et al. | 102/472 |
| 6,332,403 | B1 | * | 12/2001 | Weise et al. | 102/472 |

FOREIGN PATENT DOCUMENTS

| | | |
|---|---|---|
| EP | 1 434 025 A1 | 6/2004 |
| GB | 2 191 566 A | 6/1986 |

OTHER PUBLICATIONS

Notification of Transmittal of the International Search Report and the Written Opinion of the International Searching Authority, or the Declaration for application No. PCT/US2008/065297; (14 pages), Apr. 28, 2009.

*USPTO; Office Action*; U.S. Appl. No. 12/355,322, filed Jan. 16, 2009, in the name of Robert A. Bailey; (8 pgs), Notification Date Oct. 15, 2010.

European Patent Office, "Communication Pursuant to Article 94(3) EPC," Application No. 08 826 920.4-1260, Oct. 19, 2010, 5 pages.

* cited by examiner

*Primary Examiner* — Bret Hayes
*Assistant Examiner* — Reginald Tillman, Jr.
(74) *Attorney, Agent, or Firm* — Baker Botts L.L.P.

(57) ABSTRACT

According to one embodiment, a cartridge includes a main explosive and an exploding foil initiator housed in a case. The exploding foil initiator includes metallic strips that are operable to initiate explosion of the main explosive in response to an electrical signal.

12 Claims, 2 Drawing Sheets

EXPLODING FOIL INITIATOR ACTUATED CARTRIDGE

RELATED APPLICATIONS

This application claims priority to U.S. Provisional Patent Application Ser. No. 60/932,514, entitled "EXPLODING FOIL INITIATOR ACTUATED CARTRIDGE," which was filed on May 30, 2007.

TECHNICAL FIELD OF THE DISCLOSURE

This disclosure generally relates to cartridge actuated devices, and more particularly, to a cartridge that may be initiated by an exploding foil initiator and a method of using the same.

BACKGROUND OF THE DISCLOSURE

A cartridge actuated device (CAD) generally refers to a type of device that may be actuated by an explosive charge. Examples of such cartridge actuated devices include powder-actuated tools, such as explosive charge powered nail guns or various types of military armament, such as bomb racks, ejection type missile launchers, ejection seats, chaff dispensers, and the like. Energy to actuate these cartridge actuated devices may be supplied by an explosive encased in a cartridge that operates in a manner similar to a shell used in a firearm. Using these cartridges, a relatively small initiation force may be able to trigger a relatively larger amount of energy for actuating the cartridge actuated device.

SUMMARY OF THE DISCLOSURE

According to one embodiment, a cartridge includes a main explosive and an exploding foil initiator housed in a case. The exploding foil initiator includes a number of metallic strips that are operable to initiate explosion of the main explosive in response to an electrical signal. The case is free of any primary explosive that is different in chemical composition from the main explosive.

Some embodiments of the disclosure may provide numerous technical advantages. Some embodiments may benefit from some, none, or all of these advantages. For example, according to one embodiment, the cartridge may provide enhanced safety over known cartridge designs for cartridge actuated devices. The cartridge according to the present disclosure has no primary explosive that may be susceptible to thermal or mechanical shock. Because the main explosive is detonated by a relatively large voltage pulse, stray voltages such as those generated by electromagnetic radiation may not be sufficient to inadvertently detonate the main explosive. An electrical signal sufficient to detonate the main explosive is provided by an electrical circuit that may include various types of failsafe circuit portions for further reduction of premature detonation.

As another example, electrical circuitry used to actuate the exploding foil initiator may be at least partially disposed external to the cartridge, thus enabling use of a portion of the electrical circuitry with a multiple number of cartridges. Thus, configuring a portion of the electrical circuitry external to the cartridges may enable cost savings by alleviating the need to replicate electrical circuitry for every cartridge used.

Another advantage that may be provided by certain embodiments includes a cartridge that may be free of explosives using hazardous chemicals that may be left as residue on the cartridge actuated device following detonation. Known cartridge designs often use primary explosive materials, such as zirconium potassium perchlorate (ZPP), lead azide, or mercury fulminate that emit toxic gases when exploded. These hazardous chemicals may cause corrosion or require special disposal procedures which may be alleviated by use of the cartridge according to the teachings of the present disclosure.

Other technical advantages may be readily ascertained by one of ordinary skill in the art.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS

Cartridge actuated devices (CADs) used in military applications typically require a relatively high level of reliability. This level of reliability may be generally unattainable using cartridges that are initiated by physical impact, such as those used in firearms or by an electrically heated bridge-wire. For example, cartridges may use primary explosives that may detonate prematurely due to their relatively strong sensitivity to heat, mechanical shock, electrical shock, and/or electromagnetic energy.

Similar problems with demolition charges have been alleviated by implementation of exploding foil initiators (EFIs) that may be initiated by an electrical pulse of energy. Explosive devices implemented with exploding foil initiators include electrical circuitry that is operable to modify a trigger signal into a form suitable for actuating the exploding foil initiator. Because this electrical circuitry is implemented on the explosive device, it must be replicated on each explosive device used. As such, known implementations of exploding foil initiators are each configured with electrical circuitry that is not reusable.

Figure 1A:
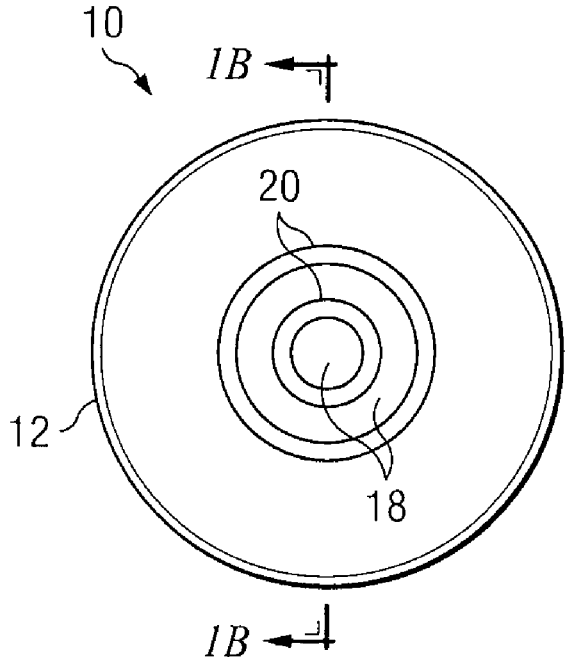
FIG. 1A is an end view of one embodiment of a cartridge according to the teachings of the present disclosure.
Figure 1B:
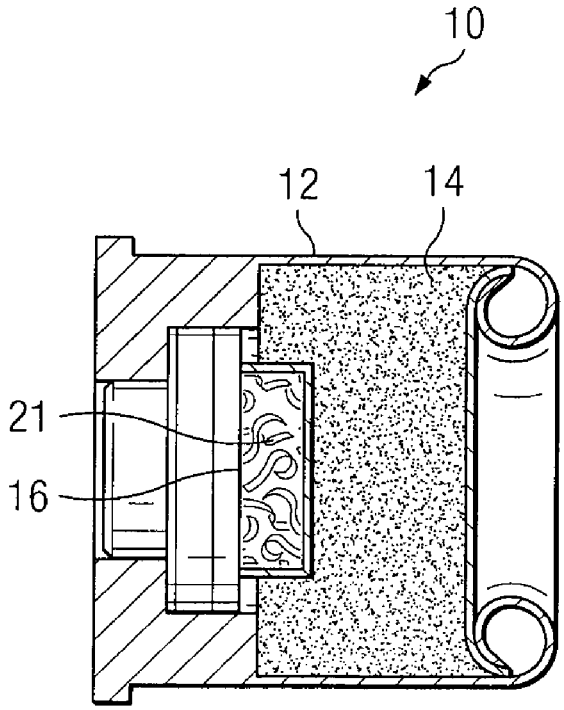
FIG. 1B is a side cross-sectional view of the cartridge of FIG. 1A.

FIGS. 1A and 1B show one embodiment of a cartridge 10 that may provide a solution to the previously described problem as well as other problems. Cartridge generally includes a case 12 that houses a main explosive 14 and is configured with an exploding foil initiator 16 for initiation of the main explosive 14. Two contacts 18 are accessible from outside the cartridge and coupled to the exploding foil initiator 16 such that application of a relatively high voltage pulse causes the exploding foil initiator 16 to operate. The two contacts 18 may be separated by insulators 20 and arranged in a circular pattern around the central portion of the case 12 for efficient coupling of the exploding foil initiator 16 to electrical circuitry (to be described below) that may be at least partially external to the cartridge 10. Main explosive 14 may include any suitable type of explosive that may be detonated by exploding foil initiator 16.

According to the teachings of the present disclosure, exploding foil initiator 16 includes a number of relatively thin metallic strips 21 that explode due to a relatively high pulse of electrical energy. Exploding foil initiator 16 may include a number of these metallic strips 21 that are coupled to contacts 18 such that an electrical signal placed across contacts 18 causes an electrical current to be conducted through metallic strips 21. Metallic strips 21 may have a specified thickness and width such that the electrical signal may dissipate sufficient energy for detonation of metallic strips 21. In one embodiment, metallic strips 21 may have a specified thickness and width such that a pulse signal having an amplitude of approximately 1000.0 volts causes metallic strips 21 to explode. In one embodiment, the thin metallic strips 21 are formed of copper that has been sputtered to a relatively precise thickness using a sputtering process and subsequently cut into strips having a specified width.

Figure 2:
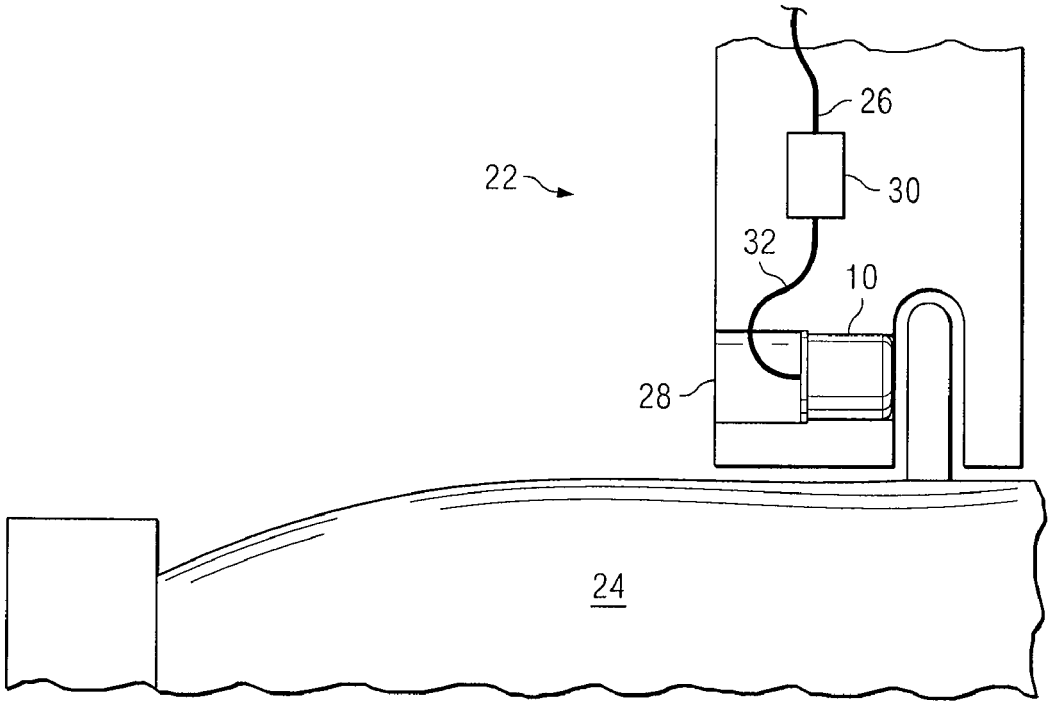
FIG. 2 is an illustration of one embodiment of a cartridge actuated device that may use the cartridge of FIG. 1A.

FIG. 2 is an illustration showing one embodiment of a cartridge 10 configured in a cartridge actuated device 22. In the particular embodiment shown, cartridge actuated device 22 is a bomb rack that deploys a bomb 24 in response to a trigger signal present on a trigger wire 26. In other embodiments, cartridge actuated device 22 may be any type of device that uses a relatively small trigger signal to initiate an explosive in order to actuate a particular operation. For example, cartridge actuated device may be other types of military equipment, such as a missile launcher, an ejection seat, or a chaff dispenser.

Cartridge actuated device 22 has a breech 28 that provides placement of cartridge 10 inside. Cartridge 10 is electrically coupled to a circuit board 30 through a pair of wires 32. Circuit board 30 has electrical circuitry that is used to modify a trigger signal present on trigger wire 26 into a signal suitable for triggering the exploding foil initiator 16. The circuit board 30 may be mounted on or in the cartridge actuated device 22 such that the output terminals of the circuit board 30 are electrically coupled to the two contacts 18. In one embodiment, circuit board 30 may be coupled to cartridge 10 through spring loaded contacts (not shown).

In one embodiment, circuit board 30 is disposed in relative close proximity to cartridge 10. In this manner, wires 32 coupling the circuit board 30 to cartridge 10 may be relatively short for reducing susceptibility to stray electro-magnetic radiation and providing relatively good energy transferal of electrical signals from circuit board 30 to cartridge 10.

Circuit board 30 converts a trigger signal present on trigger wire 26 to an electrical signal suitable for operating exploding foil initiator 16. In a particular embodiment in which cartridge actuated device 22 is a piece of military equipment such as a bomb rack, the trigger signal may be a pulse signal having an amplitude of approximately 28.0 volts.

The circuit board 30 may use any type of suitable electrical circuit, such as a charge pump, using electrical components that generate a relatively larger signal pulse for operating the exploding foil initiator 16. Electrical components that may be used for this purpose may include transistors, capacitors, inductors, resistors, solid-state switches, and the like. In the particular embodiment shown, electrical components of electrical circuit are configured on circuit board 30 such that cartridge 10 has no electrical components. By configuring the electrical components exterior to cartridge 10, the electrical circuitry may be repeatedly used with a number of cartridges 10. Certain embodiments of cartridge 10 that are free of electrical circuitry may provide an advantage in that the cartridge 10 may have reduced costs due to the ability to reuse electrical circuitry with a multiple number of cartridges 10.

In other embodiments, cartridge 10 may be configured with a portion of the electrical components used to implement the electrical circuitry. In this manner, the other portion of electrical components configured on circuit board 30 may be reused to actuate multiple cartridges 10 while other electrical components configured in cartridge 10 are replaced with each use. Certain embodiments in which a portion of electrical components are implemented within cartridge 10 may provide an advantage in that the length of electrical wiring between these electrical components and exploding foil initiator 16 may be relatively short for enhanced protection from stray electromagnetic radiation and relatively good energy transferal to the exploding foil initiator 16.

Figure 3:
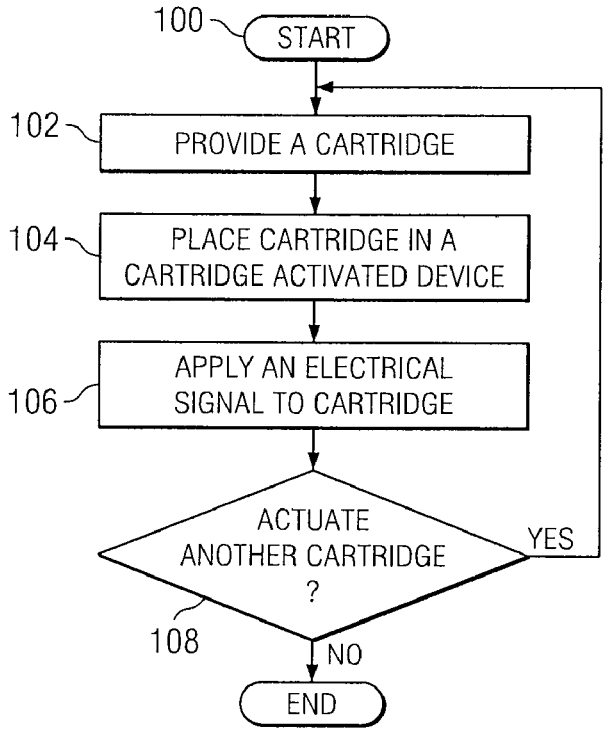
FIG. 3 is a flowchart showing one embodiment of a series of actions that may be performed to use the cartridge of FIG. 1.

FIG. 3 is a flowchart showing one embodiment of a series of actions that may be performed to use cartridge 10 according to the teachings of the present disclosure. In act 100 the process is initiated.

In act 102, a cartridge 10 is provided. Cartridge 10 has an exploding foil initiator 16 including multiple metallic strips 21 that operate in response to a relatively high voltage pulse. Cartridge 10 is disposed in any suitable cartridge actuated device 22, such as a bomb rack in act 104.

In act 106, an electrical signal is applied to contacts 18 of cartridge 10 such that the cartridge actuated device is actuated. In one embodiment, the electrical signal is applied to cartridge 10 using an electrical circuit that amplifies a smaller voltage pulse to a larger one suitable for operating exploding foil initiator 16. At least a portion of the electrical circuit is disposed on circuit board 30 that is external to cartridge 10 such that the portion of electrical circuit may be reused with multiple cartridges 10.

In act 108, another cartridge 10 may be used to actuate another cartridge actuated device by repeating acts 102 through 106 with another cartridge 10. When actuation of other cartridge actuated devices are no longer needed or desired, the process ends in act 110.

Modifications, additions, or omissions may be made to the previously described method without departing from the scope of the disclosure. The method may include more, fewer, or other acts. For example, application of an electrical signal to cartridge 10 may be provided by circuit board 30 having a charge pump circuit that converts a 28.0 volt pulse signal into a 1000.0 volt signal suitable to operate exploding foil initiator 16.

Although the present disclosure and its advantages have been described in detail, it should be understood that various changes, substitutions, and alterations can be made therein without departing from the spirit and scope of the disclosure as defined by the appended claims.

What is claimed is:

1. A cartridge comprising:

a main explosive for generating gas that is used to actuate a cartridge actuated device;

a case for housing the main explosive; and an exploding foil initiator disposed in the case and comprising a plurality of metallic strips that are operable to explode upon receiving an electrical signal, the explosion of the plurality of metallic strips operable to initiate explosion of the main.

2. The cartridge of claim 1, further comprising at least a portion of an electrical circuit disposed within the case, the electrical circuit operable to generate the electrical signal in response to a trigger signal.

3. The cartridge of claim 1, wherein the cartridge is devoid of any portion of an electrical circuit operable to generate the electrical signal in response to a trigger signal.

4. The cartridge of claim 1, wherein the exploding foil initiator comprises two conductive contacts that are accessible from outside of the case, the two conductive contacts are coupled to an electrical circuit and operable to receive the electrical signal from the electrical circuit.

5. The cartridge of claim 1, wherein the electrical signal is a pulse having an amplitude of approximately 1000.0 volts.

6. A system comprising:

a cartridge actuated device, the cartridge actuated device comprising a military device that is selected from the group consisting of a bomb rack, a missile launcher, an ejection seat, and a chaff dispenser; and a cartridge comprising:

a case including an inside and an outside;

a main explosive operable to actuate the cartridge actuated device by generating gas during an explosion, the main explosive disposed in the inside of the case;

an exploding foil initiator disposed in the inside of the case, the exploding foil initiator comprising a plurality of metallic strips that are operable to explode in response to an electrical signal received from an electrical circuit, the explosion of the plurality of metallic strips operable to initiate the explosion of the main explosive; and a pair of contacts disposed in the case, the pair of contacts being accessible from the outside of the case, the pair of contacts further extending from the outside of the case into the inside of the case, the pair of contacts being coupled to the exploding foil initiator disposed in the inside of the case.

7. The system of claim 6, wherein the cartridge actuated device includes the electrical circuit, wherein the electrical circuit is operable to convert a trigger signal to the electrical signal.

8. The system of claim 7, wherein the electrical circuit comprises a charge pump.

9. The system of claim 7, wherein the cartridge actuated device further comprises:

a breech operable to receive the cartridge; and a trigger wire operable to receive the trigger signal upon indication from a user, the trigger wire further operable to transfer the trigger signal to the electrical circuit.

10. The system of claim 6, further comprising:

the electrical circuit, wherein the electrical circuit is operable to convert a trigger signal to the electrical signal; and wherein the cartridge actuated device includes a first portion of the electrical circuit; and wherein the cartridge includes a second portion of the electrical circuit.

11. The system of claim 10, wherein the cartridge actuated device further comprises:

a breech operable to receive the cartridge; and a trigger wire operable to receive the trigger signal upon indication from a user, the trigger wire further operable to transfer the trigger signal to the electrical circuit.

12. The system of claim 6, wherein the cartridge is devoid of zirconium potassium perchlorate, lead azide, and mercury fulminate.

* * * * *

UNITED STATES PATENT AND TRADEMARK OFFICE

CERTIFICATE OF CORRECTION

PATENT NO. : 8,037,824 B1
APPLICATION NO. : 12/130626
DATED : October 18, 2011
INVENTOR(S) : Robert W. Plummer et al.

It is certified that error appears in the above-identified patent and that said Letters Patent is hereby corrected as shown below:

Column 4, Line 57:
(Claim 1) after "main" insert -- explosive --.

Signed and Sealed this
Third Day of January, 2012

David J. Kappos

David J. Kappos
*Director of the United States Patent and Trademark Office*